US006719850B2

(12) United States Patent
Glucksman et al.

(10) Patent No.: US 6,719,850 B2
(45) Date of Patent: Apr. 13, 2004

(54) SONIC JEWELRY CLEANER

(75) Inventors: Dov Glucksman, Wenham, MA (US); Karl Kaltenbach, Newton, MA (US); Gary McGonagle, Lynn, MA (US); Laura Nickerson, Andover, MA (US)

(73) Assignee: Connoisseurs Products Corp., Woburn, MA (US)

( * ) Notice: Subject to any disclaimer, the term of this patent is extended or adjusted under 35 U.S.C. 154(b) by 0 days.

(21) Appl. No.: 10/045,177

(22) Filed: Jan. 11, 2002

(65) Prior Publication Data

US 2003/0131869 A1 Jul. 17, 2003

(51) Int. Cl.[7] ..... B08B 3/12

(52) U.S. Cl. ..... 134/1; 134/184; 134/186; 134/164; 134/147; 134/92

(58) Field of Search ..... 134/1, 184, 186, 134/92, 147, 164

(56) References Cited

U.S. PATENT DOCUMENTS 3,151,846 A * 10/1964 George ..... 134/184
3,291,458 A * 12/1966 Hamm ..... 366/110
4,112,955 A * 9/1978 Gollel ..... 134/57 R
4,167,341 A * 9/1979 Doyel ..... 366/114
6,494,222 B1 * 12/2002 Mitsumori et al. ..... 134/184

* cited by examiner

*Primary Examiner*—Zeinab El-Arini
(74) *Attorney, Agent, or Firm*—Choate, Hall & Stewart

(57) ABSTRACT

The present invention provides a small, quiet sonic cleaner which can be used to clean jewelry and other small objects. The cleaner includes a tank which is rigidly connected to a vibration generator such as an eccentrically loaded motor, and which is flexibly coupled to a base upon which the cleaner sits. The coupling of the tank to the base is preferably through progressive motion attenuators such as springs, which provide superior vibration isolation for the tank.

10 Claims, 3 Drawing Sheets

SONIC JEWELRY CLEANER

FIELD OF THE INVENTION

The present application pertains to a cleaning system that uses sonic vibrations to agitate a tank of cleaning solution in which jewelry may be immersed. In particular, the system provides superior vibration isolation for the cleaning tank.

BACKGROUND OF THE INVENTION

Jewelry, especially types that are worn frequently such as wedding rings, typically becomes soiled in use and requires frequent cleaning in order to maintain its appearance. Many consumers are without means to adequately clean their jewelry at home. If they clean items at all, they must take them to a jeweler for steam cleaning or the like, which is inconvenient and usually is done infrequently.

There exist home cleaning systems for jewelry, that typically use a tank of cleaning solution in which items can be immersed. Usually means are provided for the tank to vibrate, to dislodge any particles and to ensure that the solution can circulate and clean all surfaces. Vibrations may be in the sonic range (up to about 30,000 cycles per minute), or in the ultrasonic range (above about 20,000 cycles per second). However, the vibration generators are frequently large and noisy, rendering them inconvenient for users. A need still exists for a small, quiet vibratory cleaner that can efficiently clean jewelry and other small items.

SUMMARY OF THE INVENTION

The present invention provides a small, quiet sonic cleaner which can be used to clean jewelry and other small objects. The cleaner includes a tank which is rigidly connected to a vibration generator such as an eccentrically loaded motor, and which is flexibly coupled to a base upon which the cleaner sits. The coupling of the tank to the base is preferably through progressive motion attenuators such as springs, which provide superior vibration isolation for the tank.

The invention comprises a sonic cleaner and a method of using the cleaner to clean jewelry. The cleaner includes a tank, a vibration generator coupled to the tank, and a base that supports the tank via a progressive motion attenuator (e.g., one or more springs). The progressive motion attenuator acts to isolate the base from the vibrations generated by the vibration generator. Example vibration generators include motors and electromagnetic vibrators. The tank may comprise a transparent material such as styrene acrylonitrile copolymer, and may include hooks for suspending jewelry in a cleaning solution in the tank. The hooks may be attached to the tank via a freely rotating joint, allowing them to rotate in response to vibrations from the vibration generator. The jewelry cleaner may include a power source such as a battery. The base may include a battery cover upon which it rests, the cover including a cushioned surface to vibrationally isolate the cleaner from a supporting substrate.

In use, the sonic cleaner is filled with a cleaning solution, in which jewelry is immersed. The vibration generator is then used to vibrate the tank, so as to clean the jewelry.

BRIEF DESCRIPTION OF THE DRAWING

The invention is described with reference to the several figures of the drawing, in which.

DETAILED DESCRIPTION

Figure 2:
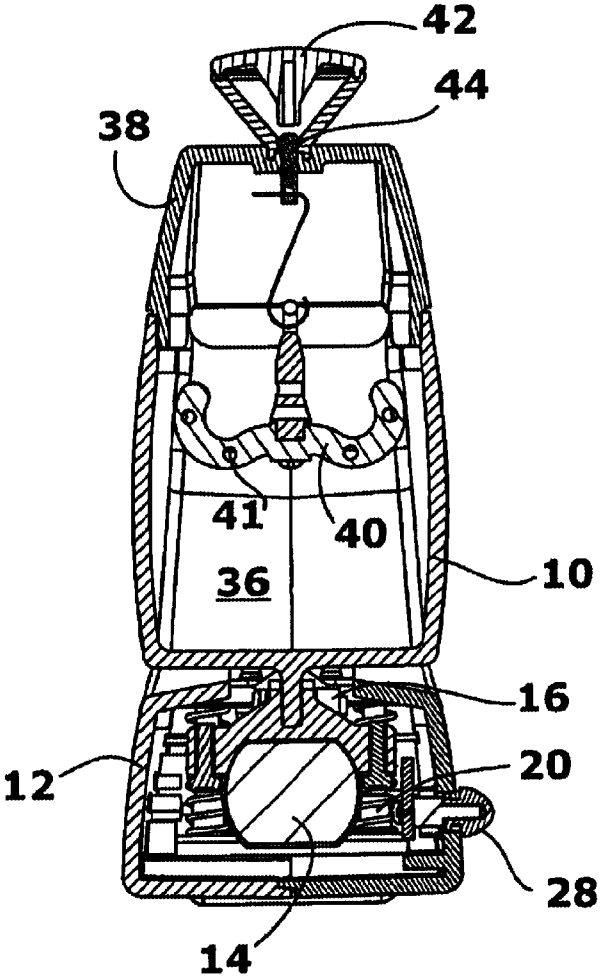
FIG. 2 is a side cross-sectional view of the jewelry cleaner of FIG. 1.
Figure 1:
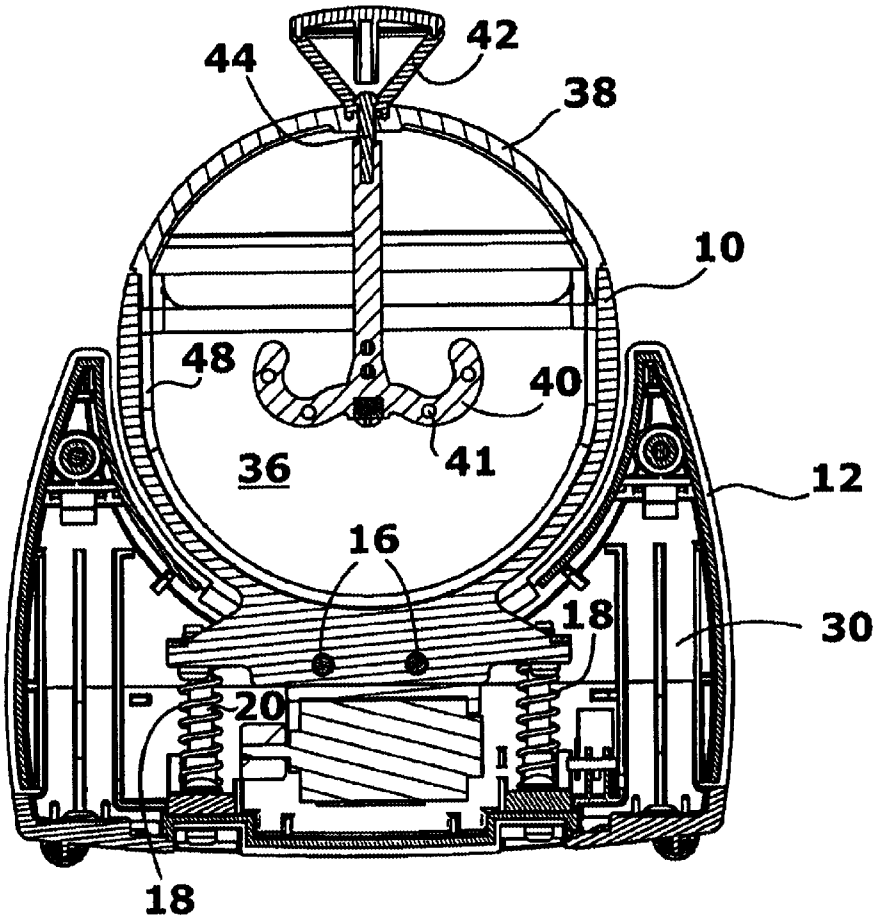
FIG. 1 is a front cross-sectional view of a jewelry cleaner according to the invention.
Figure 3:
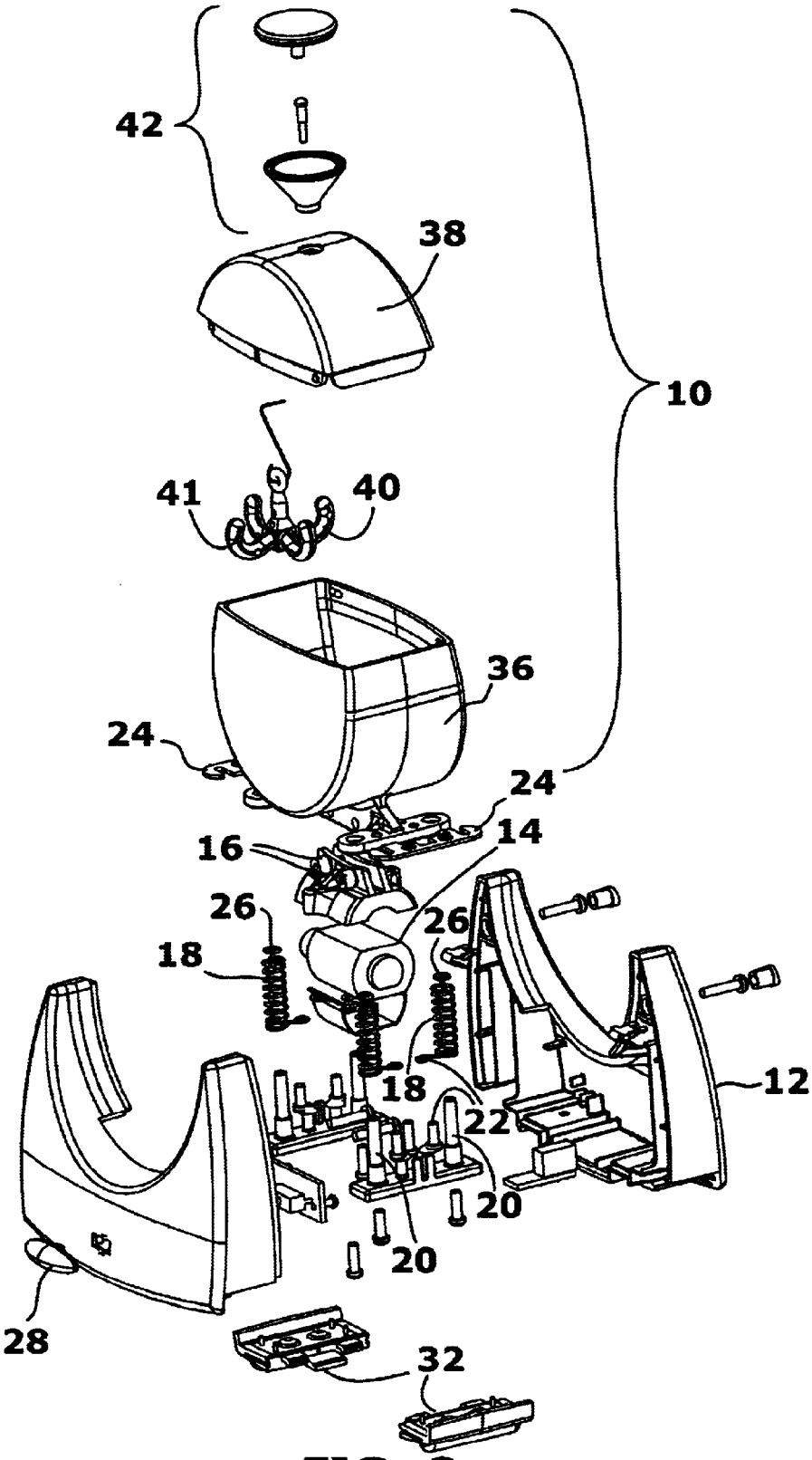
FIG. 3 is an exploded view of the jewelry cleaner of FIG. 1.

One embodiment of the present invention is shown in FIGS. 1–3. As shown, the cleaner comprises a tank 10 and a base 12. The tank is connected to a motor 14 having an eccentric attachment, which generates vibrations. The motor may be replaced with another vibration generator, such as an electromagnetic vibrator, which uses an oscillating magnetic field to attract a paramagnetic soft iron member. The motor 14 rotates at or around sonic frequencies, for example in the range of 6,000–9,000 rpm. Faster or slower rotations are also within the scope of the invention (small DC motors can achieve speeds on the order of 30,000 rpm, while electromagnetic vibrators typically run at 3,600 cycles per minute), but for the cleaning of jewelry, speeds of about 6,000–9,000 rpm have been found to provide efficacious cleaning without tending to damage gemstone settings.

The motor 14 is firmly coupled to the tank 10 via screws 16. Of course, any form of attachment suitable for transmitting vibrations may be used. The tank-motor assembly is coupled to the base 12 via springs 18. These springs provide vibration isolation for the base 12, allowing the energy generated by the motor to be efficiently coupled only to the tank assembly. Other vibration isolators, such as elastomers, may be used in the place of the springs, but it is preferred that the isolators be progressive motion attenuators. Springs and other progressive motion attenuators, in which the returning force increases with the displacement, provide superior definition of movement of the tank, reducing rattle and the possibility of energy transfer to the base if it is struck by the tank.

For convenience of assembly of the cleaner, in the illustrated embodiment, the base comprises posts 20 upon which the springs 18 ride. The posts 20 allow free vertical motion of the springs 18, and limited horizontal motion. These posts make it easier to attach the springs 18 to the tank 10 during manufacture, but otherwise do not significantly affect the behavior of the tank. In the embodiment shown, the springs 18 are attached at the base of the posts 20 via a pin-and-loop arrangement 22, but of course, any suitable arrangement can be used. Similarly, as shown, a slider plate 24 secures circular loops 26 at the top of the springs 18, but any convenient system for securing the springs to the motor-tank assembly may be used.

Since the springs provide the only support of the tank by the base, vibrations generated by the motor are very efficiently restricted to the tank. This not only allows the cleaner to use minimal power, but provides for quieter operation, since the base does not tend itself to rattle, to "walk" across a supporting tabletop, or to cause adjacent objects on the tabletop to rattle. Further, since the tank's supports are restricted to areas concealed by the base, it presents an attractive appearance, seeming to "float" within the base. This effect is enhanced when the tank is made of a transparent material, as described below.

In the embodiment shown, the motor 14 is connected to a switch (not shown), actuated by a button 28, and to a power source via one or more flexible wires (not shown). Because the wires are small and flexible, they do not provide significant coupling of the motor's vibration to the base 12. The motor may be driven either by external, rectified alternating current or by batteries. In the embodiment shown, the motor is powered by batteries. Battery locating and supporting ribs can be seen at 30. The base is provided with removable covers 32 so that the batteries can be inserted.

Figure 4:
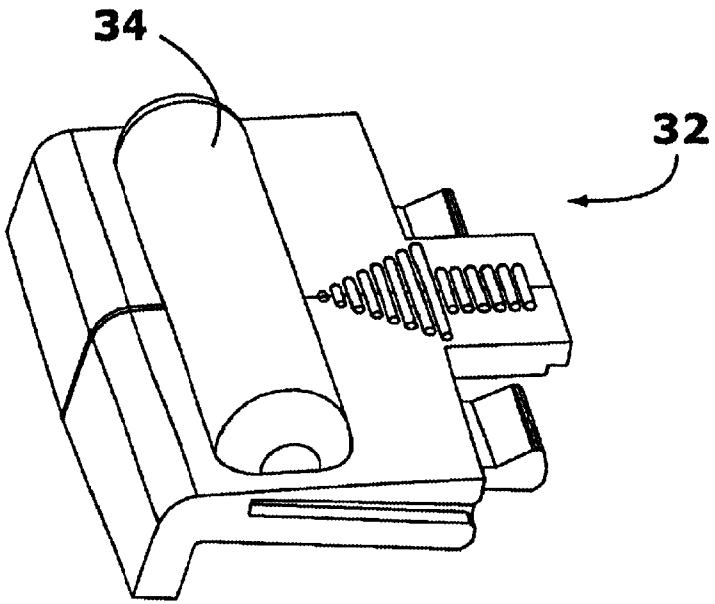
FIG. 4 is a detail of a battery cover from the jewelry cleaner of FIG. 1.

In the embodiment shown, the battery covers 32 also function as additional cushioning for the base 12. As shown most clearly in FIG. 4, each battery cover 32 comprises a cylindrical elastomer cushion 34. The shape of the cover 32 is preferably such that elastomer 34 may be easily overmolded thereon. The long cylindrical cushions 34 prevent any parasitic vibration of the base 12 from being transmitted to the surface on which it sits. While the cushions could be placed directly on the body of the base 12, it has been found that manufacturing convenience is enhanced by incorporating them into the battery covers, which are separately molded.

Tank 10 comprises a body 36, a lid 38, and hooks 40. A handle 42 may also be provided. The body 36 of the tank 10 is filled with cleaning solution. Hooks 40 are suspended from lid 38 and are designed to be at least partially immersed in the solution. The user may hang small jewelry such as rings and bracelets from the hooks 40. It may be preferred to drop larger jewelry directly into the tank 10, where it can be extricated after cleaning by use of an additional tool described below. The hooks may be provided with holes 41 where stud earrings may be secured.

It has been found that if the hooks 40 and handle 42 are attached to the lid via a freely rotating joint 44, preferably with at least a small amount of vertical play, they will rotate in response to the vibrations of the tank 10. This rotation may enhance the circulation of the cleaning fluid and improve the cleaning action. It has been found that the rotary motion of the hooks is roughly proportional to the frequency of vibration, and is also affected by weight imbalance on the hooks and by the amount of vertical play in the joint 44. Thus, the degree of rotation can be controlled by varying these parameters. The connection may be designed so that the handle 42 rotates with the hooks 40, or so that it is coupled to the lid of the tank and only the hooks 40 rotate.

It may be desirable to make the tank out of a transparent material, so that the user can observe the rotation and the cleaning action generally. It is important to select a tank material that is compatible with the cleaning solution; some common transparent plastics, such as acrylic, are clouded by commercially available cleaners. It has been found that styrene acrylonitrile copolymer (SAN) is a suitable material for the tank.

Figure 5:
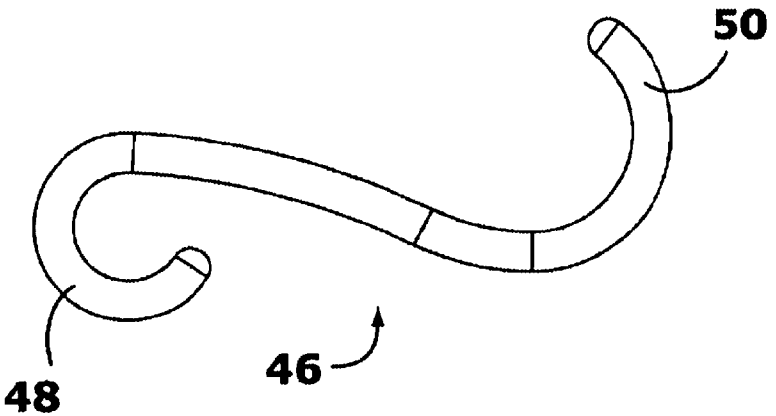
FIG. 5 is a tool that may be used with a jewelry cleaner according to the invention.

FIG. 5 shows a separate tool 46 that may be provided for use with the cleaner. The tool includes a narrow hook 48 at one end, and a wide hook 50 at the other end. The narrow hook 48 is typically used to suspend jewelry in the tank by hand, if a user desires to quickly clean it without using the lid assembly. The wide hook 50 is used to "fish" jewelry out of the bottom of the tank, if it has been dropped in (accidentally or for cleaning). If desired, the base 12 may include a receptacle for holding the tool 46 when it is not in use, or it may simply be stored in the tank.

The body of the tank 10 in the embodiment shown is approximately but not perfectly cylindrical. Since the tank is molded as a unit, it has been found that a slight narrowing of the sides as shown at 48 allows the tank to be removed from the mold. Of course, the tank may be of any appropriate shape.

The efficient coupling of vibrations to the tank and the placement of the motor in a horizontal position under the tank mean that the embodiment illustrated in the drawings is very small and lightweight. Excluding the handle, it is about five inches in height]. Its small size makes it particularly appropriate for consumer use. However, the principles of the invention may be applied to larger cleaners, and to sonic and ultrasonic immersion cleaners for objects other than jewelry, and it is intended that such uses be included within the scope of the invention.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. A sonic cleaner, comprising a tank adapted to hold a cleaning fluid;

a vibration generator coupled to the tank; and a base supporting the tank via a progressive motion attenuator, and hooks for supporting the object to be cleaned, said hooks disposed so as to be immersed in a cleaning solution contained in the tank, wherein the hooks are attached to the tank via a freely rotating joint;

wherein the progressive motion attenuator acts to isolate the base from vibrations generated by the vibration generator.

2. The sonic cleaner of claim 1, wherein the vibration generator is selected from the group consisting of motors and electromagnetic vibrators.

3. The sonic cleaner of claim 1, wherein the progressive motion attenuator comprises one or more springs.

4. The sonic cleaner of claim 1, wherein the tank is at least partially transparent.

5. The sonic cleaner of claim 4, wherein the tank comprises styrene acrylonitrile copolymer.

6. The sonic cleaner of claim 1, wherein the hooks rotate in response to vibrations from the vibration generator.

7. The sonic cleaner of claim 1, wherein the base comprises a power source for the vibration generator.

8. The sonic cleaner of claim 7, wherein the power source comprises at least one battery, and wherein the base comprises a removable cover for the battery, the cover being disposed such that the base rests upon the cover.

9. The sonic cleaner of claim 8, wherein the cover is cushioned to provide vibration isolation for the cleaner.

10. A method of cleaning jewelry, comprising:

providing a sonic cleaner according to claim 1;

filling the tank of the sonic cleaner with a cleaning solution;

immersing the jewelry in the cleaning solution; and generating vibrations in the tank with the vibration generator to clean the jewelry.

* * * * *